US010605425B2

(12) United States Patent
Gromfeld

(10) Patent No.: US 10,605,425 B2
(45) Date of Patent: Mar. 31, 2020

(54) LUMINOUS MOTOR-VEHICLE DEVICE, AND LIGHTING AND/OR SIGNALLING UNIT EQUIPPED WITH SUCH A DEVICE

(71) Applicant: VALEO VISION, Bobigny (FR)

(72) Inventor: Yves Gromfeld, Angers (FR)

(73) Assignee: VALEO VISION, Bobigny (FR)

( * ) Notice: Subject to any disclaimer, the term of this patent is extended or adjusted under 35 U.S.C. 154(b) by 0 days.

(21) Appl. No.: 16/287,230

(22) Filed: Feb. 27, 2019

(65) Prior Publication Data

US 2019/0264884 A1 Aug. 29, 2019

(30) Foreign Application Priority Data

Feb. 27, 2018 (FR) ..... 18 51731

(51) Int. Cl.

| | |
|---|---|
| ***F21S 41/20*** | (2018.01) |
| ***F21S 41/141*** | (2018.01) |
| ***F21S 41/663*** | (2018.01) |
| ***F21S 41/25*** | (2018.01) |
| ***F21S 41/153*** | (2018.01) |
| ***F21S 41/143*** | (2018.01) |
| ***F21S 41/265*** | (2018.01) |
| ***F21Y 115/10*** | (2016.01) |
| *F21W 102/14* | (2018.01) |
| *F21W 102/155* | (2018.01) |

(52) U.S. Cl.

CPC ..... *F21S 41/285* (2018.01); *F21S 41/141* (2018.01); *F21S 41/143* (2018.01); *F21S 41/153* (2018.01); *F21S 41/25* (2018.01); *F21S 41/265* (2018.01); *F21S 41/663* (2018.01); *F21W 2102/14* (2018.01); *F21W 2102/155* (2018.01); *F21Y 2115/10* (2016.08)

(58) Field of Classification Search

CPC ..... F21S 41/141; F21S 41/285; F21S 41/143; F21S 41/153; F21S 41/25; F21S 41/265; F21S 41/663

See application file for complete search history.

(56) References Cited

U.S. PATENT DOCUMENTS

2016/0368414 A1* 12/2016 Son ..... F21S 41/255

FOREIGN PATENT DOCUMENTS

| | | |
|---|---|---|
| DE | 10 2013 113 148 A1 | 5/2015 |
| DE | 10 2014 110 282 A1 | 1/2016 |
| EP | 2 306 075 A2 | 4/2011 |
| JP | 2016-212962 | 12/2016 |
| JP | 2017-174830 | 9/2017 |
| JP | 2017-224468 | 12/2017 |

OTHER PUBLICATIONS

French Preliminary Search Report dated Oct. 25, 2018 in French Application 18 51731, filed on Feb. 27, 2018 (with English Translation of Categories of Cited Documents).

* cited by examiner

*Primary Examiner* — Thomas M Sember
(74) *Attorney, Agent, or Firm* — Oblon, McClelland, Maier & Neustadt, L.L.P.

(57) ABSTRACT

A luminous device including a first row of light sources for generating first unitary beams and a second row of light sources for generating second unitary beams. The first unitary beams have a sloped profile. The first unitary beams and second unitary beams are associated so as to construct a resultant beam provided with a slope and with a section extending laterally from the slope.

20 Claims, 4 Drawing Sheets detail A

LUMINOUS MOTOR-VEHICLE DEVICE, AND LIGHTING AND/OR SIGNALLING UNIT EQUIPPED WITH SUCH A DEVICE

The present invention in particular relates to a luminous motor-vehicle device, and to a lighting and/or signalling unit equipped with such a device.

One preferred application relates to the motor-vehicle industry, and regards equipment for vehicles and in particular the production of devices capable of emitting light beams, which are also referred to as lighting and/or signalling functions and which are required in general to meet regulations. The invention may allow a light beam to be produced in front of the vehicle.

Motor-vehicle signalling and/or lighting lights are luminous devices that comprise one or more light sources and an outer lens that closes the light. Simplistically, the light source emits light rays to form a light beam that is directed toward the outer lens in order to produce an illuminating land that transmits the light to the exterior of the vehicle. These functions must meet regulations with respect to light intensity and angles of visibility in particular. Known lighting and signalling modules have up to now been provided for example to emit:

- a downward-directed low beam, sometimes also called a dipped beam, which is used in case of the presence of other vehicles on the road;
- a high beam, which is devoid of cutoff and characterized by a maximum illumination on the axis of the vehicle;
- a fog light, characterized by a flat cutoff and a large illumination width;
- a signalling beam for urban driving, also called a city light.

FIG. 1 illustrates a motor vehicle 1 being driven in one lane 2 of a highway adjacent to another lane 3.

In low-beam mode, as illustrated in FIG. 1, a light beam emitted by front headlamps has a first lighting zone 4 that extends to the ground in the lane 2 in which the vehicle 1 is being driven, and a second lighting zone 5 that extends to the ground in the lane 3.

It is known that the second lighting zone 5 contains a cutoff 6 so that the area of the second lighting zone 5 is smaller than the area of the first lighting zone 4. The cutoff 6 makes it possible not to dazzle a driver of a vehicle driving in the lane 3.

A device for emitting a light beam is known from document EP-A1-2306074, said device comprising a plurality of light-emitting diodes that are organized in the form of a matrix array of rows and columns of diodes, each diode being associated with a complex optical element allowing a unitary portion of the overall beam to be projected. Individual and selective control of the diodes allows a resultant beam to be shaped with a great deal of shape-defining freedom. For example, to produce a low beam, only the rows of the matrix array emitting under the horizon are activated contrary to high beams; furthermore, to form a cutoff corresponding to the shape illustrated in FIG. 1, the highest row activated in the low-beam mode is not completely turned on, so as to generate illumination, with this row, only in a preset lateral zone in front of the vehicle. The solution proposed in EP-A1-2306074 could appear to be satisfactory in terms of beam-shape flexibility. However, this proves not to be the case in particular when a cutoff is to be precisely defined.

The present invention aims to at least partially remedy the drawbacks of the prior art.

The present invention relates, according to one aspect, to a luminous device for a motor vehicle, said device comprising a plurality of light sources and an optical system that is configured to produce an exit beam from light rays issuing from at least some of the plurality of light sources, characterized in that it includes:

- a first luminous module comprising a row of first illuminating units that are each configured to produce a slope-comprising unitary beam formed, by a first unitary beam, with a first unitary-beam shape having an upper section provided with a first lateral edge comprising a slope extending to a top of the upper section of the first unitary beam so that a widthwise dimension of the upper section tends to decrease towards the top;
- a second luminous module comprising a row of second illuminating units that are each configured to produce a second unitary beam with a second unitary-beam shape having a rectangular upper section.

Advantageously, each of the first unitary beams is associated with one of the second unitary beams so that an upper corner of the upper section of the second unitary beam of said one of the second unitary beams coincides with the top of the upper section of the associated first unitary beam and so that the upper section of the second unitary beam extends laterally from said upper corner, opposite the slope of the associated first unitary beam.

Thus, the sloped shape confers on the resultant projection an inclined cutoff, this corresponding to a more gradual shape than that produced by current pixel matrix arrays, with which the cutoffs are vertical. At the same time, the rest of the upper portion of the resultant beam extends laterally from the slope uniformly by virtue of the rectangular or possibly square shape of at least one second beam starting from the first beam. Furthermore, the device still benefits from the discretization allowed by matrix arrays of LEDs, allowing the projection to be adapted to the desired lighting and/or signalling functions.

It is advantageously also possible to produce a light beam in low-beam mode that follows the geometry of the road, without needing to resort to a pivoting mechanical system and while nonetheless benefiting from a cutoff with an inclined edge.

According to another aspect, the present invention also relates to a motor-vehicle lighting and/or signalling unit equipped with at least one luminous device. This unit may comprise at least one additional device configured to produce a low-beam base beam. For example, the additional device may allow essentially below the horizon line to be uniformly illuminated. The device of the invention may for example allow at the very least the cutoff zone of a low beam to be defined.

Another aspect of the invention is a method for controlling a luminous device.

The present invention also relates to a vehicle equipped with at least one device and/or one unit according to the present invention.

According to one particularly advantageous embodiment, the device is such that the upper section of the unitary first-beam shape is a trapezium defined by the first lateral edge, a second lateral edge opposite to the first lateral edge and comprising a slope, a first base located level with the top and a second base, of width larger than the first base and opposite to the first base.

Thus a shape comprising two slopes is provided making it possible to create a beam cutoff on the right or on the left.

Advantageously, the unitary first-beam shape comprises a rectangular lower section in the continuity of the second base.

It is thus in particular possible to spread the unitary first beam downward, for example to just below the horizon line, preferably so as to create a graded joint with another beam, for example a base portion of a low beam projected in a spread way mainly or entirely under the horizon line.

According to one embodiment, the trapezium is isosceles.

Optionally, the width of the first base is equal to that of the upper section of the second unitary beam.

In this way, the second unitary beam may be located strictly in the continuity of the first base, between the two slopes; the zone of overlap of the two unitary beams is then very small and does not affect the slopes.

Preferably, the height of the upper section of the first beam is equal to the height of the upper section of the second unitary beam.

The concordance in the shape of the two unitary beams is correspondingly increased.

Furthermore, the largest width of the upper section of the first unitary beam is two times larger than the largest width of the shape of the second unitary beam.

The pitch of the pixels corresponding to the row of second unitary beams is thus half as much, providing a higher resolution in this portion for defining the resultant high beam. The number of light sources assigned to the second unitary beams is therefore higher than the number of light sources assigned to the first unitary beams, and preferably about two times higher.

Furthermore, it preferably includes, for each first illuminating unit, a first light source belonging to the plurality of light sources, and a first optical element associated with said first light source and configured to receive light from said associated first light source and to transmit one of the first unitary beams.

Optionally, each second illuminating unit includes a second light source belonging to the plurality of light sources, and a second optical element, which is associated with said second light source and configured to receive light from said associated second light source and to transmit one of the second unitary beams.

Advantageously, the first luminous module is configured to produce, for each first unitary beam, an additional first unitary beam.

Preferably, the additional first unitary beams are each located in the continuity of and above a first unitary beam.

According to one nonlimiting embodiment, the first luminous module includes at least one additional row of additional first light sources belonging to the plurality of light sources, and at least one additional row of additional first optical elements that are each associated with a different one of the additional first light sources, each additional first light source and the associated additional first optical element being configured to produce an additional first unitary beam.

Advantageously, the association of the additional row of additional first light sources and of the additional row of additional first optical elements is configured to produce an exit-beam projection that is mainly or even completely above the horizon line, in order to produce or participate in the production of a portion of a high beam.

Preferably, the second luminous module includes at least one additional row of additional second light sources belonging to the plurality of light sources, and at least one additional row of additional second optical elements that are each associated with a different one of the additional second light sources, each additional second light source and the associated additional second optical element being configured to produce an additional second unitary beam.

Advantageously, the association of the additional row of additional second light sources and of the additional row of additional second optical elements is configured to produce an exit-beam projection that is mainly or even completely above the horizon line, in order to produce or participate in the production of a portion of a high beam.

According to one nonlimiting example, the additional secondary unitary beams are each located in the continuity of and above a second unitary beam.

Furthermore, a third luminous module includes a row of third light sources belonging to the plurality of light sources, and third optical elements, which elements are individually associated with a different one of the third light sources and are configured to receive light from said associated third source and to each transmit a sloped unitary beam formed by a third unitary beam, with a third unitary-beam shape determined by a shape of the third optical elements, the third unitary-beam shape having an upper section provided with a first lateral edge comprising a slope extending to a top of the third unitary-beam shape so that a widthwise dimension of the upper section tends to decrease toward the top; and wherein each of the third unitary beams is associated with one of the second unitary beams so that an upper corner of the upper section of the second unitary beam of said one of the second optical elements coincides with the top of the third unitary beam of the associated third optical element and so that the upper section extends laterally opposite the slope of the third unitary beam of the associated third optical element; and wherein the first unitary beam and the third unitary beam that are associated with a given second unitary beam are offset laterally.

By virtue of the third module, an additional element for generating sloped unitary beams is provided. The delivery of these additional slopes increases the resolution of definition of the border of the envelope of the resultant beam; when it is a question of the cutoff of a low beam, there is then a larger number of potential cutoff edges along the width of the possible complete beam.

Preferably, the shape of the first unitary beam and the shape of the third unitary beam are identical.

Advantageously, the luminous modules each comprise a field optical element.

According to one example, a projecting optical element is common to the luminous modules.

Preferably, control means comprise a low-beam control configuration in which the control means are configured to turn on only a single light source assigned to a slope-comprising unitary beam and to turn on a series of at least one light source assigned to a second unitary beam so as to form a resultant beam section in the lateral continuity of said slope-comprising unitary beam.

In this way, the row of first sources and optionally the row of third sources serves only to generate a single unitary beam at a time, whereas the row of second sources serves to generate the rest of the width of the beam to be formed (in particular that low-beam zone which includes the cutoff). By limiting the superposition of the illumination of the slope-comprising unitary beams and the illumination of the third unitary beams, the localized overbrightness effects that could occur if more beams of slope-comprising shape were simultaneously activated may be limited or even avoided. The low-beam portion generated by the slope-comprising unitary beam and by the second unitary beams may form the low-beam section located in the vicinity of the horizon line (the top portion of the low beam); the rest of the low beam may be formed by a complementary beam, such as a so-called flat beam, i.e. a beam that is straight and uniform, essentially under the horizon line.

Optionally, one of the luminous modules, and particularly advantageously the second luminous module, comprises a row of marking light sources each source of which is associated with a marking optical element. This assembly allows a plurality of marking unitary beams to be generated, said beams being able to be used to produce a discrete projection element below the horizon line, either so as to form a base section of a low beam, or so as to create extra illumination in the base section of a low beam that is moreover generated. For example, a marking-line function allowing a zone in front of the vehicle to be more brightly illuminated may be produced in this way. In this configuration, a series of at least one marking light source may alone be turned on in order to produce a strip of extra brightness in the bottom portion of the low beam.

Optionally, the plurality of sources each comprise at least one light-emitting diode.

Advantageously, at least one among the row of first optical elements, the row of second optical elements, the row of third optical elements and any additional rows of optical elements is produced from a single piece of one material, in particular an optical material such as PMMA (polymethyl methacrylate), the optical elements of a given row being juxtaposed edge-to-edge in the widthwise direction of the beam to be produced.

The invention also relates to a motor-vehicle lighting and/or signalling unit equipped with at least one device such as described above.

Other features and advantages of the present invention will be better understood from the exemplary description and the drawings, in which.

Figure 1:
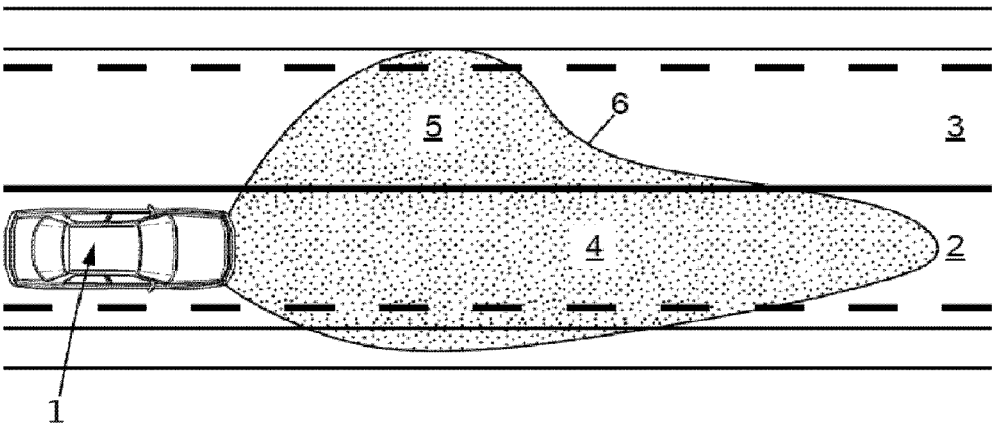
FIG. 1 shows a top view of a section of highway lane and the projection of a low beam in front of a motor vehicle.
Figure 2:
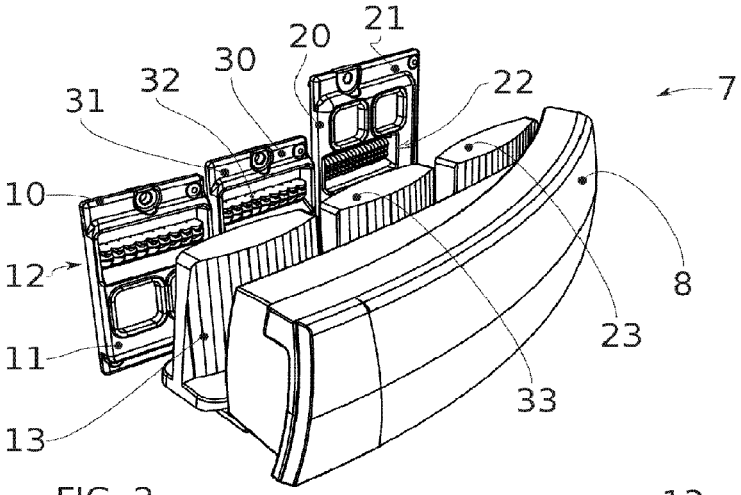
FIG. 2 is a perspective view of components of the invention in one embodiment.
Figure 3:
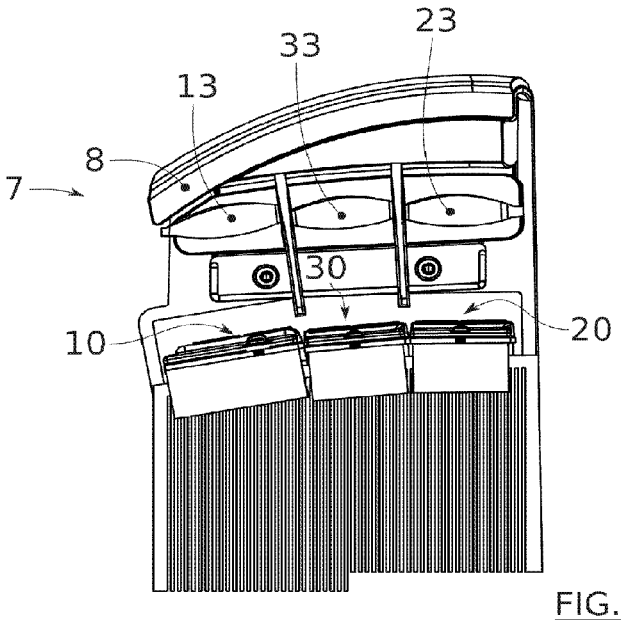
Figure 4:
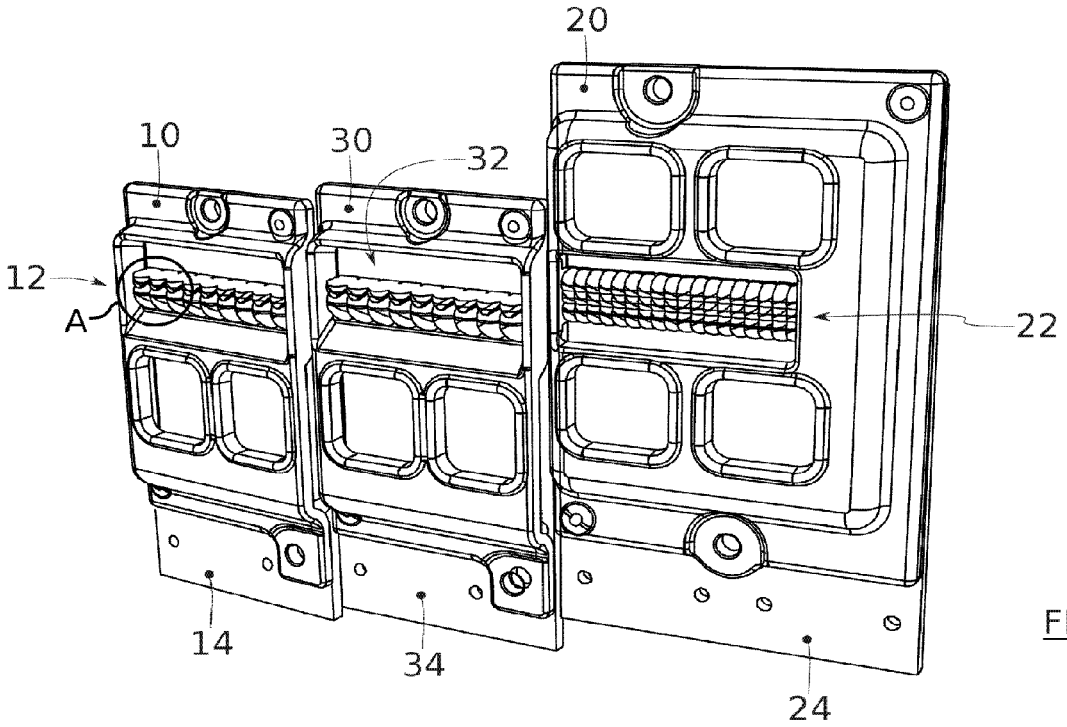
Figure 4A:
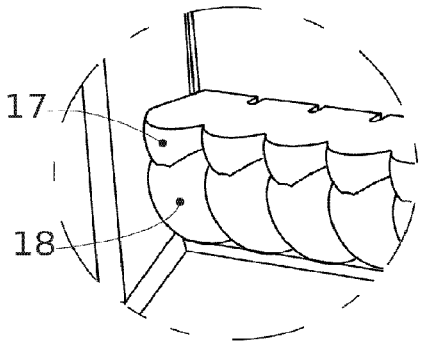
Figure 5:
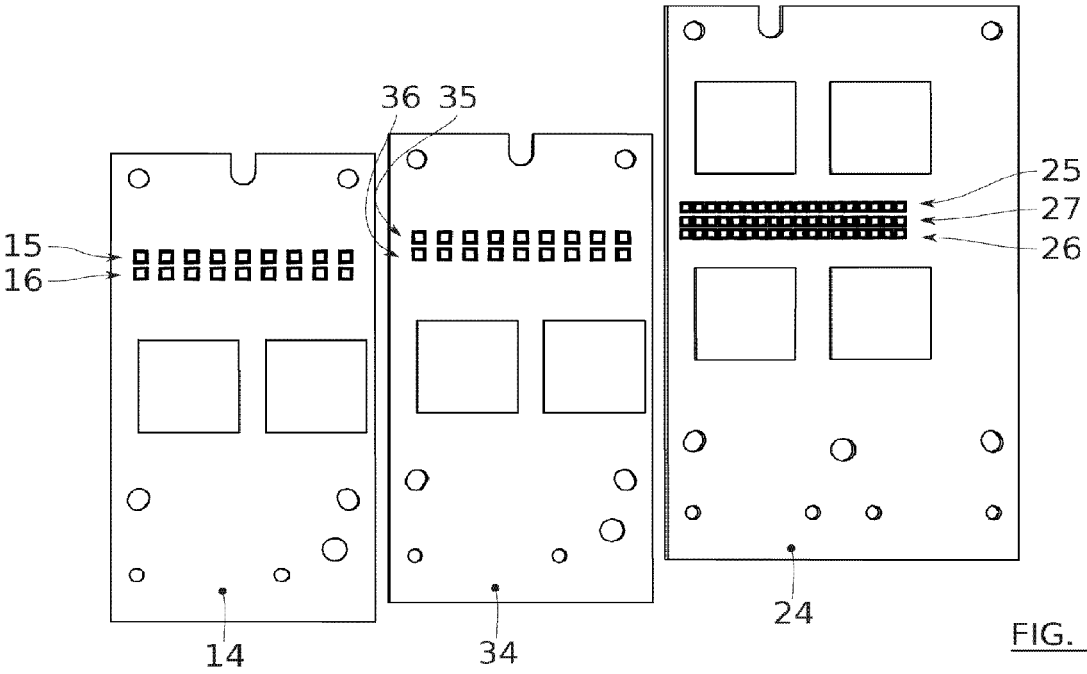
Figure 6:
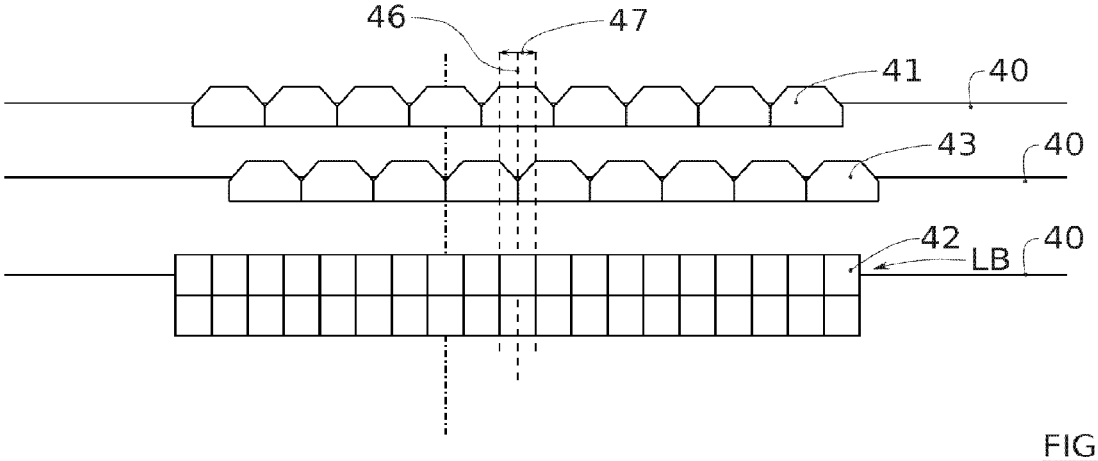
Figure 6A:
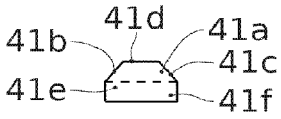
Figure 6B:
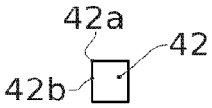
Figure 7:
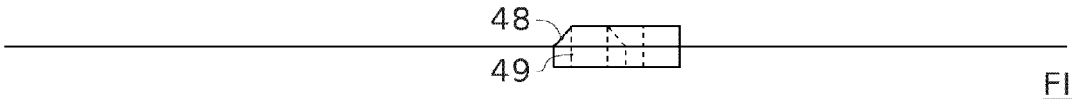
Figure 8:
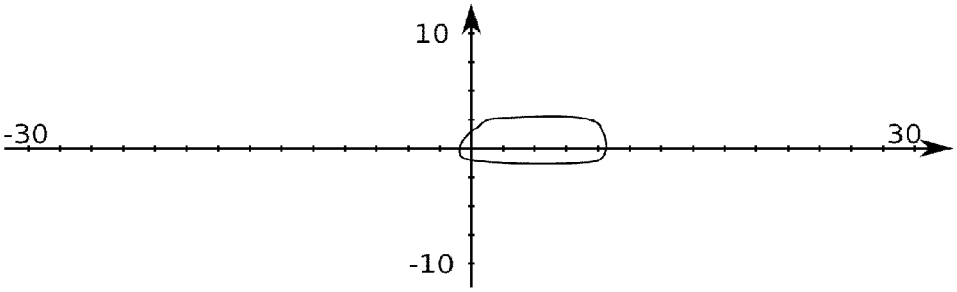
Figure 9:
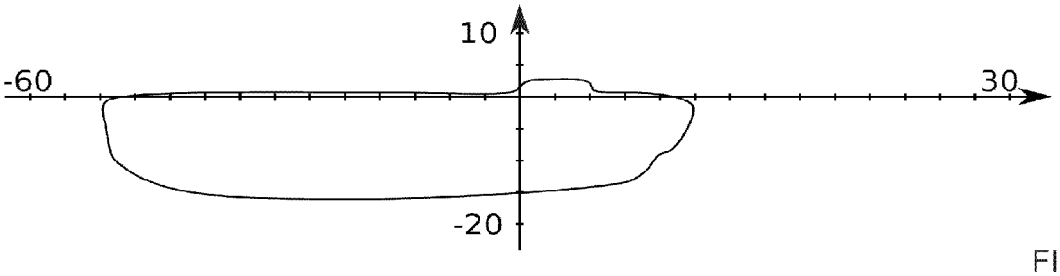
Figure 10:
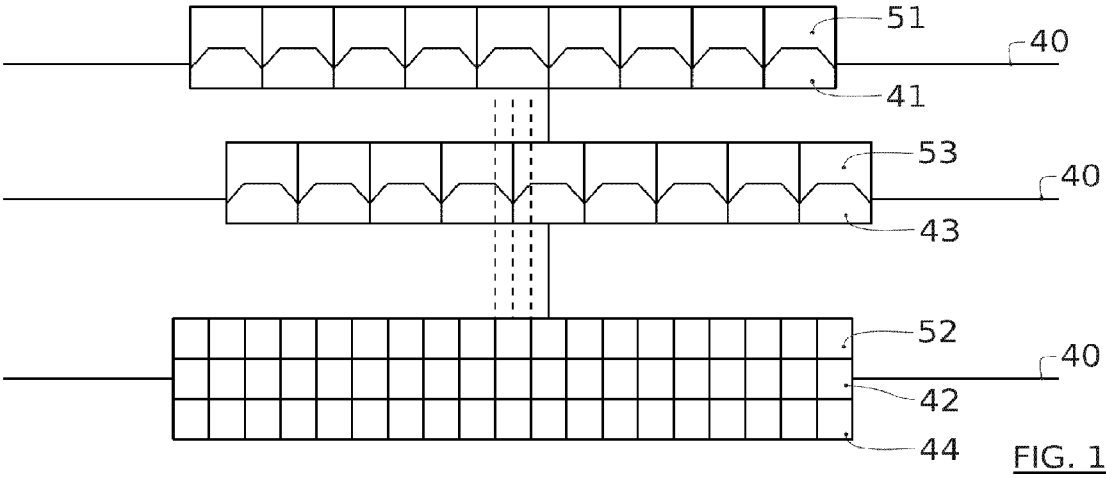
Figure 11:
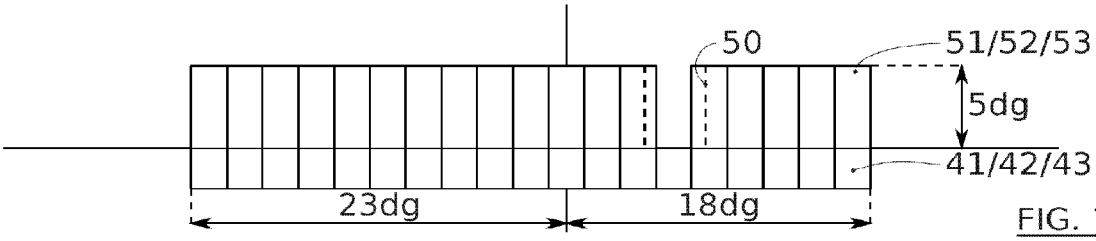

FIG. 3 gives a top view of a device according to FIG. 2;

FIG. 4 shows face-on one device portion displaying optical elements taking the form of lenses;

FIG. 4A gives an enlarged example of lens shape;

FIG. 5 illustrates light sources taking the form of LEDs, these sources being associated with the optical elements of FIG. 4;

FIG. 6 schematically shows, in 3 rows, the unitary beams that it is possible to obtain from, in succession, a first module, a third module and a second module, in one embodiment, the third module also producing in this case a beam performing a marking-line function;

FIG. 6A gives a more precise view of a slope-comprising unitary beam able to form a first unitary beam or a third unitary beam;

FIG. 6B provides an example of a second unitary-beam shape;

FIG. 7 shows, on the basis of the possible unitary-beam arrangements in FIG. 6, an example of a cutoff-containing section of a low beam obtained by selectively turning on certain light sources of the modules;

FIG. 8 gives, in projection in a vertical plane in front of the vehicle, an example of a beam envelope resulting from the case in FIG. 7;

FIG. 9 is a projection in a vertical plane in front of the vehicle of a low beam combining the cutoff-containing beam shown in FIG. 8 and an complementary low beam, forming a base of the overall beam;

FIG. 10 is an illustration of complementary unitary beams that the modules may produce, in addition to the first, second and third unitary beams;

FIG. 11 shows how it is possible to modulate the illumination of full-beam headlights, by virtue of selective control of the turn-on of certain light sources.

Unless specifically indicated otherwise, technical features described in detail for one given embodiment may be combined with technical features described in the context of other embodiments described by way of nonlimiting example.

In the features described below, terms relating to verticality, horizontality and transversality, or the equivalents thereof, are to be understood with respect to the position in which the lighting module is intended to be mounted in a vehicle. The terms "vertical" and "horizontal" are used in the present description to designate directions, the term "vertical" indicating an orientation perpendicular to the plane of the horizon, and the term "horizontal" indicating an orientation parallel to the plane of the horizon. They are to be understood with respect to the operating conditions of the device in a vehicle. The term "width" is understood to mean a dimension oriented in the horizontal direction and the term "height" is understood to mean a dimension oriented along the vertical. The word "lateral" is understood to mean a position of an element relative to another in the widthwise dimension. The use of these various words does not mean that slight variations about the vertical and horizontal directions are excluded from the invention. For example, an inclination relative to these directions of about + or −10° is here considered to be a minor variation about the two preferred directions.

In the context of the invention, by low beam what is meant is a beam employed in the presence of oncoming and/or followed vehicles and/or other elements (individuals, obstacles, etc.) on the road or close by. This beam has a downward average direction. It may possibly be characterized by an absence of light above a plane inclined 1% downward on the side of oncoming traffic, and above another plane inclined by 15° with respect to the preceding one on the side of traffic driving in the same direction, these two planes defining a cutoff that meets European regulations. The aim of this downward upper cutoff is to avoid dazzling other users present in the road scene in front of the vehicle or on the sides of the road. The low beam, which at one time was generated by a single headlamp, has seen changes, the low-beam function now being able to be coupled with other lighting features that are also considered to be low-beam functions in the context of the present invention.

These functions in particular comprise the following:

AFS functions (AFS being the abbreviation of Advanced Frontlighting System), which in particular provide other types of beams. It is in particular a question of the function called BL (Bending Light), which may be subdivided into a function called DBL (Dynamic Bending Light) and a function called FBL (Fixed Bending Light); these functions allow the low beam to be modified whilst the vehicle is being driven and in particular allow the position of the cutoff to be modified in a horizontal direction depending on the driving conditions and in particular on turns in the road. According to one possibility, detection of the angle of rotation of the steering wheel is used to modify the lateral position of the cutoff; it is thus possible to automatically control the direction of the beam emitted by the front headlamps of the motor vehicle depending on an angle of rotation of the steering wheel, this ensuring that the direction of the beam follows the geometry of the road on which the vehicle is being driven, and in particular the path of the vehicle into a corner.

the function called the "Town Light" function. This function widens the low beam while slightly decreasing its range;

the function called the "Motorway Light" function, for its part is used when driving on motorways. This function increases the range of the low beam by concentrating the light flux of the low beam on the optical axis of the headlamp device in question;

the function called the "Overhead Light" function. This function modifies a typical low beam so that sign gantries located above the road are illuminated satisfactorily by means of the low beam;

the function called the "Adverse Weather Light" (AWL) function.

In contrast, the function of a basic high beam is to illuminate a large extent of the scene in front of the vehicle, but also to a substantial distance, typically about 200 metres. This light beam, because of its lighting function, is mainly located above the horizon line. It may for example have a slightly ascending optical axis of illumination.

The device may also serve to form other lighting functions via or separately to those described above.

As is known per se, light sources are used. Generally, the present invention may use light-emitting diodes (LEDs) as light sources. It may optionally be a question of one or more organic LEDs. In particular, these LEDs may be provided with at least one chip employing a semiconductor technology and suitable for emitting light of an intensity that is advantageously adjustable depending on the lighting and/or signalling function to be produced. Moreover, the term "light source" is here understood to mean a set of at least one elementary source such as an LED able to produce a flux leading at least one light beam to be generated as output from the module of the invention. In one advantageous embodiment, the exit face of the source is of rectangular cross section, this being typical for LED chips.

The invention comprises a plurality of modules each allowing at least one type of unitary beam to be emitted. They are preferably juxtaposed, i.e. arranged in a horizontal direction of alignment. The term "module" does not mean that the modules are necessarily completely separate units; it simply means that they are units for forming distinct beams; they may share common portions, such as a holder, a projecting optic or electronic elements, such as electronic control elements for example.

"Unitary beam" is here understood to mean an elementary beam that may be generated alone or in association with other unitary beams of the same type (i.e. advantageously of the same shape) and optionally with one or more unitary beams of at least one other type. In one embodiment of the invention, these unitary beams, which are activatable at will, allow, in the desired location in front of the vehicle, a cutoff-containing beam to be produced by association of a slope-comprising unitary beam (providing the shape of a sloped cutoff) and of at least one rectangular unitary beam; the desired location may be modified, in particular depending on curves in the highway lane, by modifying the activated unitary beams while the vehicle is moving. The slope-comprising unitary beam is a beam at least one portion of the lateral border of which is inclined, preferably in a straight line, relative to the horizon line, this inclination being such that the slope-comprising beam makes, in this location, an acute angle to the horizon line. An example of the invention will be given below in which the slope-comprising unitary beams are produced by two modules, the first and third modules, but a single module may be enough.

FIG. 2 gives an example of a device 7 according to the invention with three modules. The first module 10 is intended, in particular in the present case, to produce first unitary beams. It comprises a holder to which lenses 12 forming the optical elements of light sources have been added. The lenses 12 are organized into rows, as are the corresponding sources, as detailed below. A field optical element 13, which may be a biconvex lens, may also be seen in FIG. 2. FIG. 2 also shows a representation of components, which may be similar, for a second module 20: holder 21, lenses 22 and field optical element 23. Likewise, for the third module 30: holder 31, lenses 32 and field optical element 33. Preferably, the three modules 10, 20, 30 share the same projecting optical element (typically a lens).

The modules in question may also be seen from above in FIG. 3. The light produced by a light source of a module is first shaped by a lens of the module, then by the field lens and is lastly projected by the element 8.

The light sources are therefore each associated with one optical element (one lens 12, 22, 32) so as to form in combination an illuminating unit that produces a unitary beam of a shape defined by the optical element.

The organization of the lenses and of the light sources may be clearly seen in FIGS. 4, 4*a* and 5 in particular. In FIG. 4, the front face of the lenses 12, 22, 32 is shown. These lenses are located downstream of the light sources (which are masked in FIG. 4) but borne by electronic boards 14, 24, 34 that may be seen. Regarding the first module 10, two rows of superposed lenses 12 may be seen. Similar rows are formed for the third module. In this example, the second module 20 comprises three rows of superposed lenses 32.

Advantageously, each optical element comprises or is a lens, and, preferably, a microlens. The microlens preferably has dimensions that are of substantially the same order of magnitude as those of an LED. Preferably, the lens is a spherical lens, a focal point of which is placed behind the LED matrix array. This advantageously allows an enlarged virtual image to be generated behind the LED matrix array, which image is projected by a projecting element to infinity. Alternatively, the element for projecting to infinity may image the exit surface of the lens.

Regarding the first and third modules 10, 30, FIG. 4*a* gives an example of the shape of these lenses or more generally of these optical elements. A row of first optical elements 17 is organized in a way ensuring the cutoff slopes. Another row of additional optical elements is also present, for delivering additional beams, in particular for a high-beam portion, in a matrix-beam function. In the illustrated case, the elements 17 and 18 are the same in number and are associated pairwise so as to be vertically aligned; each pair of elements 17, 18 is of rectangular envelope and the element 18, which forms the counter of element 17, here comprises a trapezium-shaped section. They are preferably integrally formed from the same material—such as PMMA. The lenses forming the second optical elements of FIG. 4 are generally of simpler shape because the beam shapes are here preferably rectangular (this including square shapes). Advantageously, their width is half the width of the lenses of the other modules (at the very least, the second-unitary-beam lenses 22 are two times less wide than the lenses 12 and 32). It will be seen that this choice of dimensions ensures a particular distribution of the projected beams.

FIG. 5 shows the organization of the light sources of the three modules 10, 20, 30. In alignment with the lenses 12 forming the first optical elements 17, the first module 10 comprises a row of first sources 15 taking the form of laterally aligned LEDs. A row of additional LEDs 16 is in alignment with the row of elements 18. Equivalently, the third module 30 includes a row of third sources 35 and a row of additional sources 36, in association with the row of third optical elements 37 and with the third row of additional optical elements 38, respectively. Since the second module 20 comprises three rows of optical elements in this embodiment, it comprises in alignment three rows of light sources. The row 25 allows the second unitary beams to be produced. The second row 26 produces matrix-beam unitary beams, as in the case of the rows 16 and 36. The row 27 produces unitary beams, in association with the third row of optical elements of the second module, for an additional lighting function, for example a marking-line function. Preferably, the row 27 is located above the row 25, opposite to the row 26. At the very least, the row 25 of the second module 20 has a resolution that is twice (a pitch of half as much between the sources) that of the sources forming the slope-comprising beams.

FIGS. 6 to 11 illustrate the illuminations that it is possible to produce by virtue of the invention.

FIG. 6 shows the result of a projection assuming that all the first, second and third unitary beams are projected simultaneously in addition to all the marking beams.

The first row illustrates the first unitary beams, each of which forms one pixel 41 of the first beam issuing from the first module 10. This pixel 41 comprises a trapezium-shaped upper section forming the slope-comprising portion of the unitary beam. Preferably, the trapezium is isosceles and/or the slope of at least one lateral side is of 45° relative to the horizon line. The upper section is preferably at least partially and possibly completely projected above the horizon line 40. Another portion of each pixel 41 is generated at the base of the trapezium in the form of a rectangle located in the continuity of the large base of the trapezium. The row of pixels 41 may be symmetric about a central pixel 41 through the middle of which a vertical axis 46 of mean projection passes.

The second row shows pixels 43 of unitary beams of identical shape to that of the pixels 41. These beams are third beams generated by the third module 30. The pixels 43 are nevertheless laterally offset relative to the pixels 41, with an offset pitch 47 advantageously corresponding to the length of the small base, i.e. the upper base, of the trapezium-shaped section of the unitary beams.

The third row shows pixels 42, 44 that are produced by the second module 20. The pixels 42 correspond to the second unitary beams described above and the pixels 44 to pixels of the marking-line function. The latter are preferably rectangles located in the downward continuity of the second-unitary-beam pixels.

FIG. 6 furthermore shows that one pixel 42 in two is advantageously aligned with the small base of a trapezium as regards one of the rows of pixels 41, 43 (the row of pixels 41 in FIG. 6) and preferably provision is made for the small base of the trapeziums to coincide with the upper side of the pixel 42 corresponding to this alignment. The other pixels 42 are preferably aligned with the small base of a trapezium of a pixel 43. Preferably, the height of that portion of the pixels 42 which is located above the horizon line 40 is identical to the height of the upper section of the pixels 41, 43. The row of pixels 42 is advantageously symmetric about the line 46. There may be therein nine pixels 41, 43 and nineteen pixels 42.

The shape of a pixel 41 (which shape is advantageously identical to the shape of the pixels 43) is illustrated in detail in FIG. 6*a*. The upper section 41*a* is a trapezium the lateral edges 41*b* and 41*c* of which are symmetrical. The inclination is here of 45° so that the width of the first base 41*d*, i.e. the small base, is half the width of the second base 41*e*, i.e. the large base. The first base 41*d* forms the top of the shape of the first unitary beam. The pixel 41 here includes a rectangular lower section an upper edge of which is formed by the second base 41*e*. The base 41*e* is here located on the horizon line. It is not absolutely necessary according to the invention for the pixel 41 to include a lower section; in particular, the pixel 41 may consist solely of the upper section. The lower section may however soften the transition between the pixel 41 and another beam portion, in particular the edge of a so-called flat beam that is complementary to the pixels 41, 42, 43, which are activated to form a complete low beam. Moreover, the trapezium shape is nonlimiting and recourse could be made to other shapes having at least one slope on one lateral edge—for example a triangle and possibly an isosceles triangle.

FIG. 6*b* gives an example of a second pixel 42. It is here a question of a square of sides 42*a*, 42*b* that are of identical length to the width of the first base 41*d*. This dimension is preferably also equal to the height of the first pixel 41. This shape defines an upper edge that may coincide with the first base of the trapezium. Generally, provision is made for a corner of the rectangular shape to fit perfectly with one of the ends of the top of the slope-comprising shape (preferably the trapezium).

In low-beam mode, only a single portion of the pixels 41, 42, 43 is turned on so as to produce a cutoff-containing top low-beam portion. One of the pixels 41, 43 will define the cutoff; the other pixels 41, 43 are preferably then turned off. A pixel 42 that is coincident with the first base of the two activated pixels 41, 43 is also activated. Advantageously, at least one other pixel 42, in the continuity of the pixel 42 in question, is also activated, to form a set of activated pixels 42 in the continuity of the cutoff slope defined by the activated pixel 41, 43. This configuration is shown in FIG. 7. The cutoff 48 is given by one of the edges of the trapezium of the activated pixel 41, 43. The rest of the resulting beam is given by pixels 42; there is a certain overlap between the pixels 42 and the activated pixels 41, 43.

It will noted that, advantageously, the lighting device also comprises means for slaving the turn-on of the LED matrix array to a sensor of a path parameter of a motor vehicle. The sensor advantageously delivers an angle of rotation of a steering wheel of the motor vehicle, the path parameter indicating a deviation of a road on which the vehicle is being driven relative to a straight line—such as, in particular, a bend. Thus, the present invention has the advantage of being able to generate a light beam for a low-beam light the cutoff of which follows the path of the vehicle on a winding road, because of a discretization of the beam into successive portions of isosceles-trapezium shape.

Furthermore, the discretization according to the present invention may be adapted to a right-hand drive vehicle and to a left-hand drive vehicle, and even allows, for a given vehicle, a change between left-hand drive and right-hand drive.

The discretization into slope-comprising shapes, and particularly into trapeziums, also allows a high beam that does not dazzle another vehicle to be formed.

Thus, the present invention allows various functions to be performed, such as: a directional low beam, left- and right-hand drive, and a non-dazzling high beam.

It will be noted that the rows of pixels 41, 43 associated with pixels 42 of two-times smaller width increases the resolution with which the cutoff may be placed.

An example of placement of the cutoff-comprising beam zone permitted by the invention is given in FIG. 8. FIG. 9 gives an example of a complete low beam resulting from the combination of the section obtained in FIG. 8 by the modules 10, 20, 30 with a complementary flat bottom beam.

According to one embodiment, the modules 10, 20, 30 may also be used to generate other beams, in a matrix-beam setup. Thus, FIG. 10 schematically shows the definition of other additional unitary beams with pixels 51, 52, 53. The latter allow a top portion of a complete beam to be generated, for example in order to produce a high beam by simultaneously turning on the pixels 41, 42, 43, 51, 52 and 53. The pixels 51, 52, 53 are in this regard respectively in the continuity of and above a pixel 41, 42, 43. FIG. 10 also shows the marking-line function with the pixels 44 this time directed below the horizon line 40.

FIG. 11 shows the high-beam shape resulting from turning on pixels 41, 42, 43, 51, 52, 53. As shown, all the pixels may not be activated simultaneously in order to isolate one section of the light, taking the form of a vertical strip, for example for an anti-dazzle vignetting function. For example, it is possible to deactivate two adjacent pixels 41, two adjacent pixels 43 and two adjacent pixels 42 in order to not illuminate a zone of width corresponding to two pixels 42. There is furthermore a soft transition between the turned-off zone and the turned-on zone because of the fact that a connecting zone 49 is illuminated only by the pixels 42 from the limit of overlap 50. In this example, the illumination extends 5° above the horizon line. The lateral angular sector is 41° with 23° on the side not upwardly illuminated (here the left-hand side) and 18° on the right-hand side.

The invention is not limited to the described embodiments but encompasses any embodiment according to its spirit.

REFERENCES

1. Motor vehicle
2. Highway lanes
3. Other lane
4. First lighting zone
5. Second lighting zone
6. Cutoff
7. Device
8. Projecting optical element
10. First module
11. Holder
12. Lenses
13. Field optical element
14. Electronic board
15. First sources
16. Additional first sources
17. First optical element
18. Additional first optical element
20. Second module
21. Holder
22. Lenses
23. Field optical element
24. Electronic board
25. Second sources
26. Additional second sources
27*a* Row of marking sources
27*b*. Marking optical element
28. Second optical element
29. Additional second optical element
30. Third module
31. Holder
32. Lenses
33. Field optical element
34. Electronic board
35. Third sources
36. Additional third sources
37. Third optical element
38. Additional third optical element
40. Horizon line
41. First-beam pixel
41*a*. Upper section
41*b*. First slope
41*c*. Second slope
41*d*. First base
41*e*. Second base
41*f*. Lower section
42. Second-beam pixel
42*a*. Upper corner
42*b*. First lateral edge
43. Third-beam pixel
44. Marking-beam pixel
46. Median axis
47. Pitch
48. Cutoff
49. Connecting zone
50. Overlap limit
51. Additional-first-beam pixel
52. Additional-second-beam pixel
53. Additional-third-beam pixel

The invention claimed is:

1. A luminous device for a motor vehicle, said device comprising a plurality of light sources and an optical system that is configured to produce an exit beam from light rays issuing from at least some of the plurality of light sources, wherein the luminous device includes:

a first luminous module comprising a row of first illuminating units configured to produce respective first unitary beams, each first unitary beam of the first unitary beams having a first unitary-beam shape that includes an upper section provided with a first lateral edge comprising a slope extending to a top of the upper section of the first unitary beam so that a widthwise dimension of the upper section decreases towards the top;

a second luminous module comprising a row of second illuminating units configured to produce respective second unitary beams, each second unitary beam of the second unitary beams having a second unitary-beam shape having a rectangular upper section;

wherein each of the first unitary beams is associated with one of the second unitary beams so that an upper corner of the upper section of the one of the second unitary beams coincides with the top of the upper section of the associated one of the first unitary beams and so that the upper section of the one of the second unitary beams extends laterally from the upper corner of the associated one of the first unitary beams opposite the slope of the associated one of the first unitary beams.

2. Device according to claim 1, wherein the upper section of the first unitary-beam shape is a trapezium defined by the first lateral edge, a second lateral edge opposite to the first lateral edge and comprising a slope, a first base located level with the top and a second base of width larger than the first base and opposite to the first base.

3. Device according to claim 2, wherein the first unitary-beam shape comprises a rectangular lower section in continuity with the second base.

4. Device according to claim 2, wherein the trapezium is isosceles.

5. Device according to claim 2, wherein the width of the first base is equal to that of the upper section of the second unitary beam.

6. Device according claim 5, wherein the height of the upper section of the first unitary beam is equal to the height of the upper section of the second unitary beam.

7. Device according to claim 1, wherein the largest width of the upper section of the first unitary beam is two times larger than the largest width of the second unitary beam.

8. Device according to claim 1, wherein:

each first illuminating unit includes a first light source belonging to the plurality of light sources, and a first optical element associated with said first light source and configured to receive light from said associated first light source and to transmit one of the first unitary beams;

each second illuminating unit includes a second light source belonging to the plurality of light sources, and a second optical element, which is associated with said second light source and configured to receive light from said associated second light source and to transmit one of the second unitary beams.

9. Device according to claim 1, wherein the first luminous module is configured to produce, for each first unitary beam, an additional first unitary beam.

10. Device according to claim 9, wherein the additional first unitary beam is located in continuity with and above the first unitary beam.

11. Device according to claim 9, wherein the first luminous module includes at least one row of additional first light sources belonging to the plurality of light sources, and at least one row of additional first optical elements that are each associated with a different one of the additional first light sources, each of the additional first light sources and each associated one of the additional first optical elements being configured to produce the additional first unitary beam.

12. Device according to claim 1, wherein the second luminous module includes at least one row of additional second light sources belonging to the plurality of light sources, and at least one row of additional second optical elements that are each associated with a different one of the additional second light sources, each of the additional second light sources and each associated one of the additional second optical elements being configured to produce an additional second unitary beam.

13. Device according to claim 12, wherein the additional second unitary beam is located in continuity with and above the second unitary beam.

14. Device according to claim 1, including a third luminous module including a row of third light sources belonging to the plurality of light sources and third optical elements, which elements are individually associated with a different one of the third light sources and are configured to receive light from said associated one of the third light sources and to each transmit a sloped unitary beam as a third unitary beam having a third unitary-beam shape determined by a shape of the third optical elements, the third unitary-beam shape having an upper section provided with a first lateral edge comprising a slope extending to a top of the third unitary-beam shape so that a widthwise dimension of the upper section thereof tends to decrease toward the top; and wherein each of the third unitary beams is associated with one of the second unitary beams so that an upper corner of the upper section of the one of the second unitary beams coincides with the top of the associated one of the third unitary beams and so that the upper section of the one of the second unitary beams extends laterally opposite the slope of the associated one of the third unitary beams; and wherein the first unitary beams and the third unitary beams that are respectively associated with corresponding second unitary beams are offset laterally.

15. Device according to claim 14, wherein the shape of the first unitary beam and the shape of the third unitary beam are identical.

16. Device according to claim 1, wherein the luminous modules each comprise a field optical element.

17. Device according to claim 16, comprising a projecting optical element that is common to the luminous modules.

18. Device according to claim 1, wherein the light sources are controllable into a low-beam configuration in which only a single light source assigned to the first unitary beam is turned on and a series of at least one light source assigned to a second unitary beam is turned on so as to form a resultant beam section in lateral continuity with the first unitary beam.

19. Device according to claim 1, wherein the plurality of light sources each comprise at least one light-emitting diode.

20. Motor-vehicle lighting and/or signaling unit equipped with at least one device according to claim 1.

* * * * *